US011512843B2

(12) United States Patent
Mizobe

(10) Patent No.: US 11,512,843 B2
(45) Date of Patent: Nov. 29, 2022

(54) FLASH LAMP

(71) Applicant: HotaluX, Ltd., Tokyo (JP)

(72) Inventor: Norimasa Mizobe, Tokyo (JP)

(73) Assignee: HotaluX, Ltd., Tokyo (JP)

( * ) Notice: Subject to any disclaimer, the term of this patent is extended or adjusted under 35 U.S.C. 154(b) by 0 days.

(21) Appl. No.: 17/479,827

(22) Filed: Sep. 20, 2021

(65) Prior Publication Data

US 2022/0003400 A1 Jan. 6, 2022

Related U.S. Application Data

(63) Continuation of application No. 16/477,427, filed as application No. PCT/JP2017/041535 on Nov. 17, 2017, now Pat. No. 11,156,349.

(30) Foreign Application Priority Data

Jan. 13, 2017 (JP) ..... 2017-003940

(51) Int. Cl.
*F21W 111/06* (2006.01)
*F21V 29/503* (2015.01)
(Continued)

(52) U.S. Cl.
CPC ..... *F21V 29/503* (2015.01); *F21V 29/51* (2015.01); *F21W 2111/06* (2013.01); *F21Y 2115/10* (2016.08)

(58) Field of Classification Search
CPC ..... F21V 29/503; F21V 29/51; F21V 29/717; F21W 2111/06; F21Y 2115/10
See application file for complete search history.

(56) References Cited

U.S. PATENT DOCUMENTS 8,390,207 B2 3/2013 Dowling
2009/0230834 A1 9/2009 Liu
(Continued)

FOREIGN PATENT DOCUMENTS

JP 2007-137187 A 6/2007
JP 2010-049951 A 3/2010
(Continued)

OTHER PUBLICATIONS

International Search Report for PCT/JP2017/041535 dated Feb. 13, 2018 [PCT/ISA/210].
(Continued)

*Primary Examiner* — Donald L Raleigh
(74) *Attorney, Agent, or Firm* — Sughrue Mion, PLLC

(57) ABSTRACT

The present invention provides a lamp capable of preventing an increase in weight and dissipating heat of the LED module. The lamp of the present invention includes an LED module serving as a light source, a heat transfer unit, a light distribution unit, a casing including an opening, and a light transmissive cover. The LED module includes plural LEDs and an LED substrate having an LED-mounting surface on which the plural LEDs are mounted. The light distribution unit is disposed on a light emitting side of the LED module.
(Continued)

The LED module and the light distribution unit are disposed in the casing. The light transmissive cover is disposed over the opening of the casing. The LED module is disposed in the casing to be distanced from the casing. The heat transfer unit is disposed such that heat of the LED module can be dissipated into the casing.

6 Claims, 5 Drawing Sheets

(51) Int. Cl.
*F21V 29/51* (2015.01)
*F21Y 115/10* (2016.01)

(56) References Cited

U.S. PATENT DOCUMENTS

| | | | | |
|---|---|---|---|---|
| 2011/0205741 | A1 | 8/2011 | Suzuki | |
| 2011/0227507 | A1 | 9/2011 | Salm | |
| 2012/0147624 | A1 | 6/2012 | Li | |
| 2013/0070461 | A1 | 3/2013 | Pickard | |
| 2013/0094192 | A1 | 4/2013 | De Boeck et al. | |
| 2014/0003046 | A1 | 1/2014 | Matsuda | |
| 2015/0109758 | A1 | 4/2015 | Allen | |
| 2015/0308655 | A1* | 10/2015 | Holmes | F21V 29/717 362/294 |
| 2015/0377452 | A1 | 12/2015 | Walesa | |

FOREIGN PATENT DOCUMENTS

| | | | |
|---|---|---|---|
| JP | 2011-175868 | A | 9/2011 |
| JP | 2012-009280 | A | 1/2012 |
| JP | 2013-525985 | A | 6/2013 |
| JP | 2014-11045 | A | 1/2014 |
| JP | 2014-211989 | A | 11/2014 |
| JP | 2015-069708 | A | 4/2015 |

OTHER PUBLICATIONS

Notice of Reasons for Refusal dated May 18, 2021 from the Japanese Patent Office in JP Application No. 2018-561834.

U.S. Department of Transportation, Advisory Circular, "Specification For Discharge-Type Flashing Light Equipment", [online], Sep. 8, 2010, Federal Aviation of Transportation, [searched on Jan. 13, 2017], Internet URL: https://www.faa.gov/documentLibrary/media/Advisory_Circular/150_5345_51b.pdf>, Sep. 8, 2010, 28 pages.

Communication dated Oct. 11, 2022 from the Japanese Patent Office in Japanese Application No. 2021-142074.

* cited by examiner

FLASH LAMP

CROSS REFERENCE TO RELATED APPLICATIONS

This application is a continuation of U.S. application Ser. No. 16/477,427, filed Jul. 11, 2019, which is a National Stage of International Application No. PCT/JP2017/041535 filed Nov. 17, 2017, claiming priority based on Japanese Patent Application No. 2017-003940, filed on Jan. 13, 2017, the entire disclosure of which is incorporated herein by reference.

TECHNICAL FIELD

The present invention relates to a lamp.

BACKGROUND ART

Conventionally, a flash lighting system using a xenon lamp has been used for guiding a landing aircraft to a runway in, for example, airports (see Non Patent Literature 1).

CITATION LIST

Non Patent Literature

Non Patent Literature 1: U.S. Department of Transportation, "SPECIFICATION FOR DISCHARGE-TYPE FLASHING LIGHT EQUIPMENT", [online], Sep. 8, 2010, Federal Aviation of Transportation, [searched on Jan. 13, 2017], Internet <URL: https://www.faa.gov/documentLibrary/media/Advisory_Circular/150_5345_51b.pdf>

SUMMARY OF INVENTION

Technical Problem

If the xenon lamp is replaced with a light-emitting diode (LED) lamp, it is possible to greatly extend the life and reduce the power consumption. However, if the LED lamp is used, an LED module installed on the LED lamp is required to dissipate heat.

In order to promote heat dissipation of the LED module, a heat dissipation fin may be provided in the LED lamp. However, the weight of a flash light (lamp) used in the flash device is specified to be 5.5 kg or less as a whole (Non Patent Literature 1). Therefore, a weight increase due to providing of a heat dissipation fin or the like is not favorable.

Hence, it is an object of the present invention to provide a lamp capable of preventing an increase in weight and dissipating heat of the LED module.

Solution to Problem

In order to achieve the aforementioned object, according to the present invention, there is provided a lamp which includes: an LED module serving as a light source; a heat transfer unit; a light distribution unit; a casing comprising an opening; and a light transmissive cover. In the lamp, the LED module includes plural LEDs, and an LED substrate having an LED-mounting surface on which the plural LEDs are mounted. The light distribution unit is disposed on a light emitting side of the LED module. The LED module and the light distribution unit are disposed in the casing.

The light transmissive cover is disposed over the opening of the casing. The LED module is disposed in the casing to be distanced from the casing. The heat transfer unit is disposed such that heat of the LED module can be dissipated into the casing.

Advantageous Effects of Invention

The present invention can provide a lamp using an LED capable of preventing weight increase and dissipating heat of the LED module.

DESCRIPTION OF EMBODIMENTS

Figure 1:
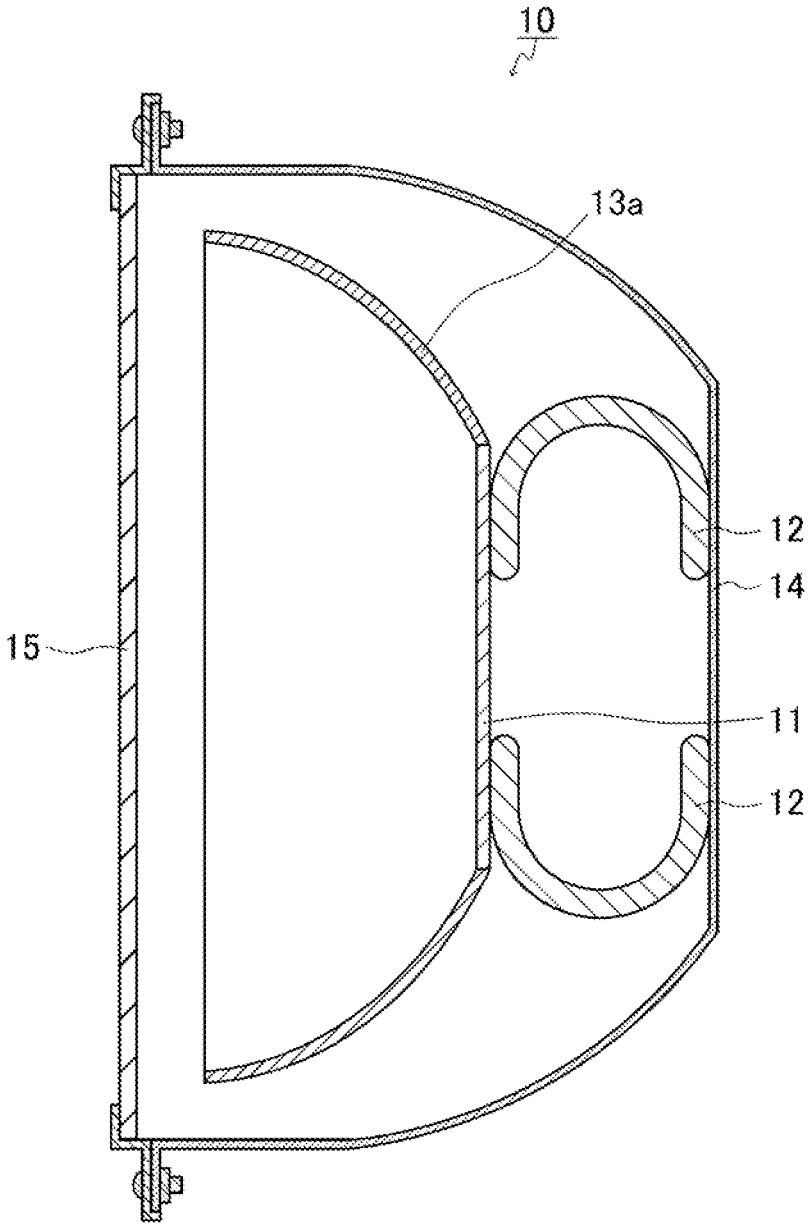
FIG. 1 is a cross-sectional view showing an example configuration of a lamp according to the first embodiment.

For example, in the lamp of the present invention, the heat transfer unit includes a heat conductive section and a heat dissipation section, the heat conductive section is disposed such that heat of the LED module is conducted, and the heat dissipation section is disposed such that heat of the LED module can be dissipated into the casing.

For example, in the lamp of the present invention, the heat dissipation section is formed at one end of the heat transfer unit, and the other end of the heat transfer unit is thermally connected to the LED module.

For example, in the lamp of the present invention, the heat dissipation section is thermally connected to the casing.

For example, in the lamp of the present invention, the heat transfer unit includes a heat pipe.

For example, the lamp of the present invention further includes a heat spreader, the heat spreader is disposed on a side of the LED module opposite to the LED-mounting surface, and the heat transfer unit is thermally connected to the heat spreader.

For example, in the lamp of the present invention, a space surrounded by the LED module, the casing, and the heat transfer unit in the casing is a wire housing section that houses wiring connected to the LED module.

For example, in the lamp of the present invention, the casing includes a connection section that can be connected to wiring outside the lamp, and the wiring housed in the wire housing section is connected to the connection section.

For example, in the lamp of the present invention, the casing includes a through hole capable of introducing wiring from the outside of the casing to the inside of the casing.

For example, in the lamp of the present invention, the light distribution unit includes at least one of a reflector or a lens.

For example, in the lamp of the present invention, the reflector has a tubular shape, and the LED module is disposed at an opening of the reflector on a light source side such that the LED-mounting surface faces an opening of the reflector on a light emitting side.

For example, the lamp of the present invention is for use in an aircraft landing guidance flash device.

Descriptions will be made as regards the lamp of the present invention more in details with reference to the drawings in the following. However, the present invention is not limited to the following description. In FIGS. 1 to 5 to be described below, the identical parts are denoted by identical reference numerals. Furthermore, in the drawings, for ease of description, illustration of the structures of the components may be simplified as appropriate, and the ratio of sizes of components and the like may be schematically indicated contrary to reality.

First Embodiment

The present embodiment shows an example of the lamp for use in an aircraft landing guidance flash device. FIG. 1 shows an example configuration of the lamp according to the present embodiment. As shown in FIG. 1, a lamp 10 according to the present embodiment includes an LED module 11 serving as a light source, a heat transfer unit 12, a light distribution unit 13*a*, a casing 14 including an opening, and a light transmissive cover 15. Although it is not shown, the LED module 11 includes plural LEDs and an LED substrate including an LED-mounting surface on which the plural LEDs are mounted (a surface on the left side in FIG. 1). As shown in FIG. 1, the LED module 11 is disposed in the casing 14 to be distanced from the casing. Moreover, the heat transfer unit 12 is disposed on a side of the LED substrate opposite to the LED-mounting surface (right side of the LED module 11 in FIG. 1). One end of the heat transfer unit 12 is thermally connected to the LED module 11, and the other end is thermally connected to the casing 14. Accordingly, the heat transfer unit 12 is disposed such that heat of the LED module 11 is dissipated into the casing 14. The reflector 13*a* serving as a light distribution unit, is disposed on a light emitting side of the LED module 11 (a left side on which the LED-mounting surface is positioned in FIG. 1). The LED module 11, the heat transfer unit 12, and the reflector 13*a* are disposed in the casing 14. The light transmissive cover 15 is disposed over the opening of the casing 14.

The LED module 11 may be one obtained by mounting a plurality of LEDs on an LED-mounting surface of the LED substrate to have the same brightness as that of a xenon lamp for a conventional aircraft landing guidance flash device, and the size and the material of the LED substrate, the number of LEDs, and the like are not particularly limited. In the lamp 10 according to the present embodiment, the LED module 11 is disposed to be distanced from the casing 14 by the heat transfer unit 12. However, the LED module 11 may be disposed not to be directly in contact with the casing 14. The LED module 11 may be disposed to be distanced from the casing 14 by a separation member or the like, for example. In the lamp 10 according to the present embodiment, the LED module 11 is disposed at an opening of the reflector 13*a* on a light source side such that the LED-mounting surface faces an opening of the reflector 13*a* on a light emitting side. However, the positional relationship between the LED module 11 and the reflector 13*a* is not limited to this, and the reflector 13*a* may be disposed on a light emitting side of the LED module 11.

In the lamp 10 according to the present embodiment, the heat transfer unit 12 is a heat pipe. However, the heat transfer unit 12 may be any heat transfer unit so long as it can transfer heat, and any of known heat transfer units can be used. Specific examples of the heat transfer unit 12 includes a member formed of a heat conductive material (heat conductive section), a heat pipe, and a combination thereof. The heat conductive material is not particularly limited and can be any of known heat conductive materials, and specific examples thereof include metals, ceramics, composite materials of ceramics and metals, and diamond. Examples of the metals include aluminium and alloys thereof, magnesium and alloys thereof, iron and alloys thereof, copper and alloys thereof, titanium and alloys thereof, molybdenum and alloys thereof, and tungsten and alloys thereof. The heat pipe is not particularly limited and can be, for example, a self-vibration heat pipe, and a commercially available product may be used. The lamp 10 according to the present embodiment includes two heat transfer units 12. However, the number of heat transfer units 12 is not particularly limited and may be one or more.

The heat transfer unit 12 may be disposed such that heat of the LED module 11 can be dissipated into the casing 14. For example, as shown in FIG. 1, one end of the heat transfer unit 12 may be thermally connected to the LED module 11, and the other end of the heat transfer unit 12 may be thermally connected to the casing 14. In the lamp 10 according to the present embodiment, one end of the heat transfer unit 12 is connected directly to the LED module 11 and however may be connected indirectly to the LED module 11. In the latter case, for example, a heat diffusion member is intervened between the LED module 11 and the heat transfer unit 12, and the heat diffusion member thermally connects the LED module 11 and the heat transfer unit 12. The heat diffusion member can be, for example, a heat spreader (integrated heat spreader) formed of the above-mentioned heat conductive material as a forming material.

Figure 2:
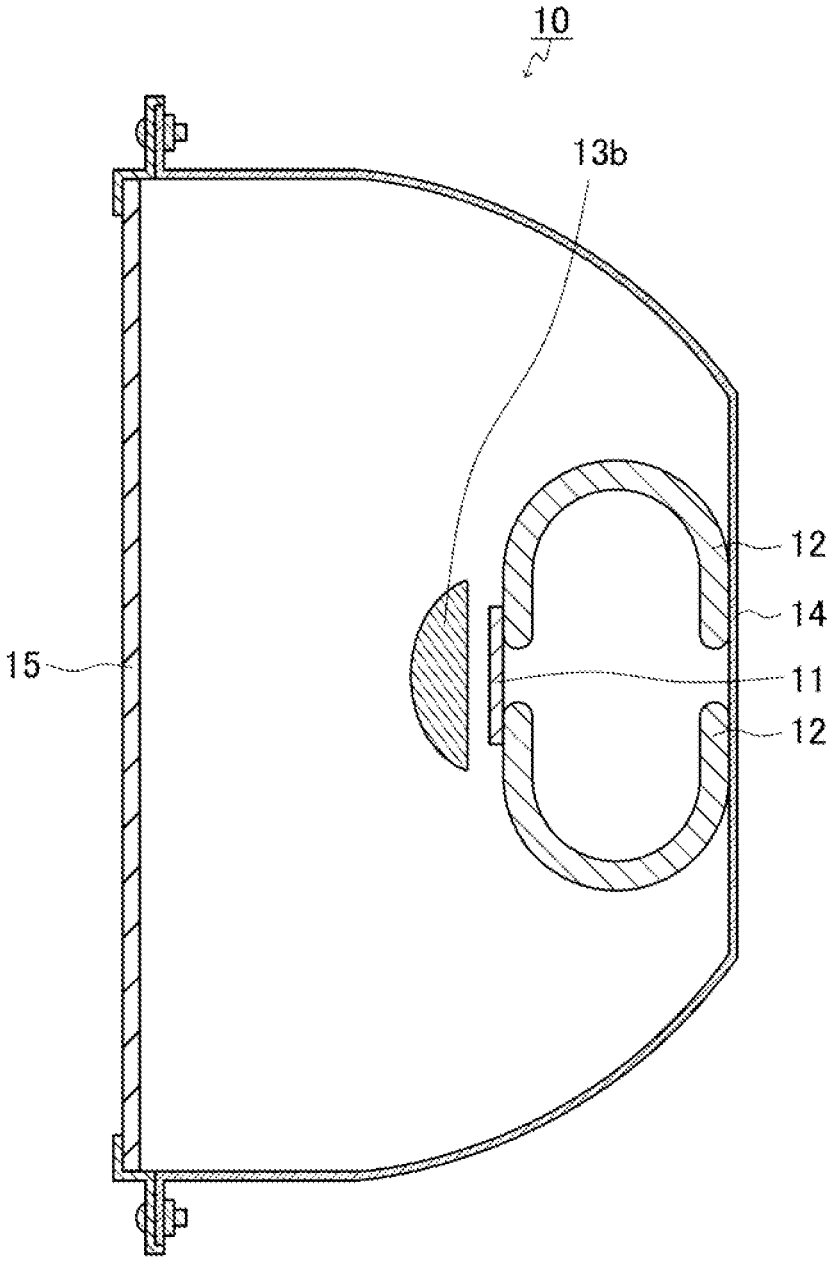
FIG. 2 is a cross-sectional view showing another example configuration of a lamp according to the first embodiment.

In the lamp 10 according to the present embodiment, the light distribution unit is a reflector 13*a* and however may be a unit that can transmit light emitted from the LED module 11 to the light transmissive cover 15 side by, for example, reflection, light gathering, and diffusion. The light distribution unit may be, for example, a reflector as included in the lamp 10 shown in FIG. 1 or a lens 13*b* as shown in FIG. 2. In the lamp of the present invention, a combination of a reflector and a lens may be used as the light distribution unit.

Examples of a material for forming the reflector 13*a* include: metals, such as aluminium and alloys thereof and magnesium and alloys thereof; and resins, such as PC and PBT. As the reflector 13*a*, a reflector having a reflection surface subjected to high reflection processing to further improve reflection efficiency may be used, for example. For example, in the lamp 10, the reflector 13*a* has a tubular shape, and the LED module 11 is disposed at an opening of the reflector 13*a* (opening on the light source side) such that the LED-mounting surface of the LED module 11 is disposed in the tube of the reflector 13*a*, i.e., faces an opening of the reflector 13*a* on the light emitting side. FIG. 1 shows an example of the reflector 13*a* having a tubular shape (e.g., an umbrella-like shape) where an area of an opening is smaller than that of the other opening. However, areas of the two openings of the reflector 13*a* may be the same. The cross-sectional shape of the reflector 13*a* may be an arc shape as shown in FIG. 1 or a flat linear shape. The reflector 13*a* may be disposed on a light source side of the LED module 11 by a support member or the like.

Examples of a material for forming the casing 14 include aluminium and resins. The casing 14 may be integrally formed as a whole or may be formed of a plurality of members. In the latter case, the casing 14 may include, for example, a tubular member and a disc-shaped member and may be formed by disposing the disc-shaped member at an opening of the tubular member on the side opposite to the side on which the light transmissive cover 15 is disposed.

A material for forming the light transmissive cover 15 may be any material which can transmit most of light emitted from the LED module 11 and can be, for example, glass.

In the lamp 10 according to the present embodiment, the heat transfer unit 12 is disposed such that heat of the LED module 11 can be dissipated into the casing 14 The heat of the LED module 11 thus can be dissipated into the casing 14 without using the heat dissipation fan. Accordingly, the lamp 10 of the present embodiment can prevent a weight increase due to providing of the heat dissipation fan or the like. Moreover, the lamp 10 according to the present embodiment is not required to use a fan whose failure is concerned so as to conduct heat inside the casing 14. Thus, for example, it is not necessary to maintain the inside of the casing 14, for example, for a period of about 20 to 30 years, which is the useful life of the LED.

The heat transfer unit 12 of the lamp 10 according to the present embodiment may include a heat conductive section and a heat dissipation section. In this case, the heat conductive section is disposed preferably such that heat to the LED module 11 is conducted, and the heat dissipation section is disposed preferably such that heat of the LED module is dissipated into the casing 14. As a specific example, the heat conductive section is thermally connected to the LED module 11. Moreover, the heat dissipation section is thermally connected to the casing 14, for example. The heat conductive section and the heat dissipation section are, for example, thermally connected to each other and, more specifically, formed integrally. The heat conductive section may be a member capable of conducting heat of the LED module 11 into the heat dissipation section and can be, as a specific example, the heat pipe or the like. The heat dissipation section may be, for example, a member capable of dissipating heat conducted from the heat conductive section into the casing 14 and can be, as a specific example, the heat conductive member or the like.

In the case where the heat transfer unit 12 includes the heat conductive section and the heat dissipation section, the positions of the heat conductive section and the heat dissipation section in the heat transfer unit 12 are not particularly limited. The heat dissipation section is formed at one end of the heat transfer unit 12, for example. In this case, a region ranging from the other end of the heat transfer unit 12 to the heat dissipation section can also be referred to as the heat conductive section. The other end of the heat transfer unit 12 is preferably thermally connected to the LED module 11.

If the heat transfer unit 12 has the heat conductive section and the heat dissipation section in this manner, the heat of the LED module 11 can be efficiently conducted from the heat conductive section to the heat dissipation section and further from the heat dissipation section to the casing 14, for example. Thus, the heat dissipation efficiency is further improved. In the case where the heat transfer unit 12 has the heat conductive section and the heat dissipation section, the heat dissipation efficiency can be optimally adjusted according to the amount of heat generated from the LED module 11 through adjusting the contact area between the heat dissipation section and the casing 14. Thus, the weight increase can be further prevented.

The lamp 10 according to the present embodiment may further include, for example, a heat spreader. In this case, the heat spreader is preferably disposed on a side of the LED substrate opposite to the LED-mounting surface, and the heat transfer unit 12 is preferably thermally connected to the heat spreader. As the heat spreader, a commercially available product may be used, for example. The heat spreader and the heat transfer unit 12 may be integrally formed. In this case, the heat spreader can also be referred to as a heat absorption section of the heat transfer unit 12. With the heat spreader included in this manner, the heat of the LED module 11 can be efficiently absorbed and dispersed and can further be efficiently conducted to the heat transfer unit 12, for example. Thus, the heat dissipation efficiency is further improved.

A space surrounded by the LED module 11, the casing 14, and the heat transfer unit 12 in the casing of the lamp 10 according to the present embodiment may be, for example, a wire housing section that houses wiring connected to the LED module 11. The wiring housed in the wire housing section can be, for example, a wiring line for supplying power to the LED module 11. The wiring in the lamp 10 is partially or entirely housed in the wire housing section, for example. As to one wiring line, the wiring line is partially or entirely housed in the wire housing section, for example. The number of wiring lines is not particularly limited, can be set, as appropriate, according to, for example, the amount of power used by the LED module 11 and may be one or more. If the lamp 10 includes the heat spreader, a space surrounded by the heat spreader, the casing 14, and the heat transfer unit 12 may be the wire housing section. With the wire housing section included in this manner, the wiring in the lamp 10 can be converged into one place. Thus, a space for the wiring can be reduced. Accordingly, the size of the casing 14 can be reduced, and the weight increase can further be prevented, for example.

For example, in the lamp 10 according to the present embodiment, the casing 14 may further include a connection section that can be connected to wiring outside the lamp 10. In this case, the wiring housed in the wire housing section is preferably connected to the connection section. The connection section is not particularly limited, and a known connector such as a powder connector can be used, for example. The connection section is preferably impervious to water for reducing failures due to providing of the connection section in the outdoors. The connection section is preferably disposed to be adjacent to the wire housing section, for example. With the connection section included in this manner, a lamp 10 having a failure occurred at the time of using it provided in an aircraft landing guidance flash device can be replaced with new lamp 10, and the aircraft landing guidance flash device thus can be immediately available, for example. Accordingly, with the connection section, the aircraft landing guidance flash device can be easily maintained, for example.

In the lamp 10 according to the present embodiment, the casing 14 includes, for example, a through hole capable of introducing wiring from the outside of the casing 14 to the inside of the casing 14. The through hole may be in size in which the wiring can be introduced.

Figure 4:
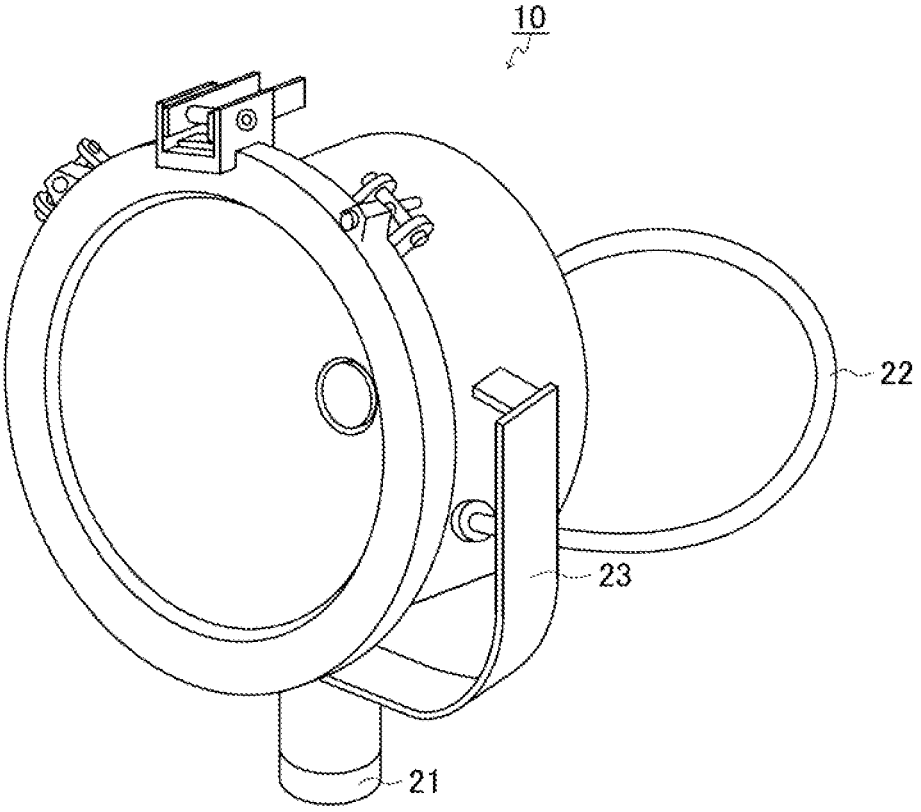
FIG. 4 is a perspective view showing an example providing the lamp according to the first embodiment.
Figure 5:
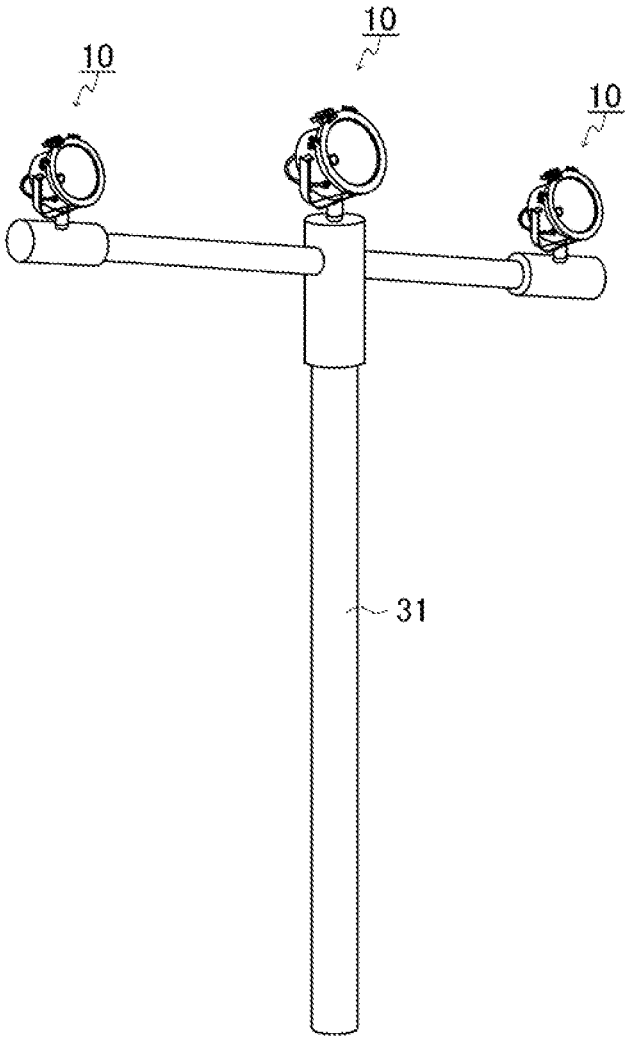
FIG. 5 is a perspective view showing another example of providing the lamp according to the first embodiment.

Next, an example of providing the lamp 10 according to the present embodiment is described with reference to FIGS. 4 and 5. The lamp 10 according to the present embodiment may further include, for example, an arm 23 and a leg 21, and may be provided on the ground by the leg 21. The lamp 10 according to the present embodiment may further include, for example, a cable (wiring) 22 for supplying power to the LED module 11. The lamp 10 shown in FIG. 4 may be provided on a pole 31 provided on the ground as shown in FIG. 5.

The lamp 10 according to the present embodiment is configured such that it can flash 120 times per 1 minute, for example. For example, if the lamp 10 according to the present embodiment is provided in a large airport having a plurality of runways, about 8 to 29 lights are provided at intervals of about 30 m from the approaching direction of the aircraft toward the end of the runway. If the lamp 10 according to the present embodiment is provided in a small airport having only one short runway where the number of aircrafts arriving and departing is small, the lamp 10 is provided such that two lamps can flash (blink) at the same time on both sides in the short-side direction at the end of the runway, for example. If the lamp 10 according to the present embodiment is provided in an airport where the aircraft cannot approach the runway straight, the lamp 10 is provided at a required location on an approach course of the runway, for example, every several kilometers. The lamp 10 according to the present embodiment is configured such that the brightness is switchable among three levels according to the standard specifications of the Ministry of Land, Infrastructure, Transport and Tourism, for example. Among these three levels of brightness, the brightest level "High" is used, for example, during the daytime of poor visibility due to fog, rain, etc., the darkest level "Low" is used, for example, at night, and the intermediate level "Middle" is used, for example, in the evening etc.

Second Embodiment

Figure 3:
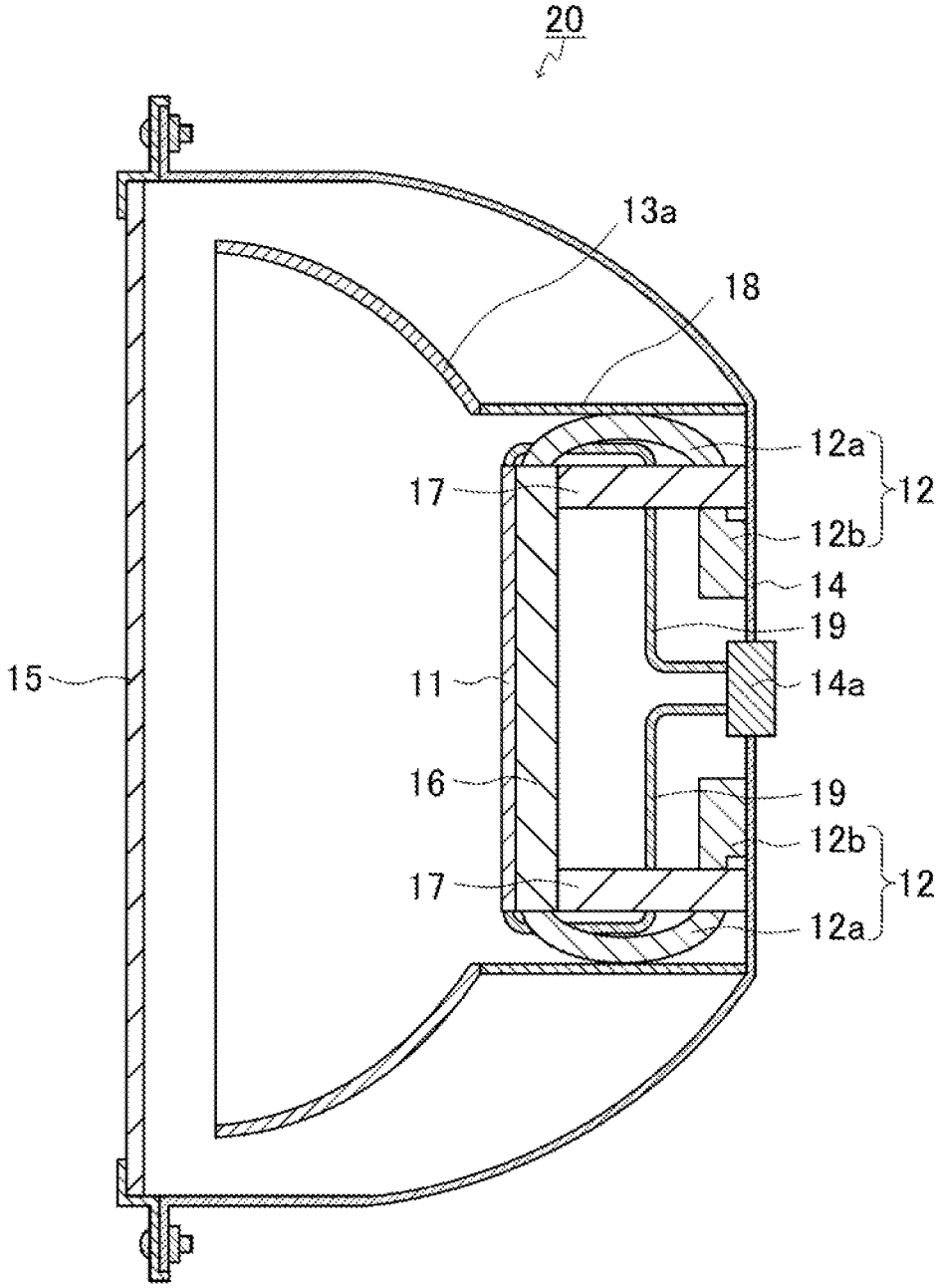
FIG. 3 is a cross-sectional view showing an example of providing a lamp according to the second embodiment.

The present embodiment shows another example of the lamp for use in an aircraft landing guidance flash device. FIG. 3 is a cross-sectional view showing an example configuration of a lamp according to the present embodiment. As shown in FIG. 3, a lamp 20 according to the present embodiment includes, in addition to the configuration of the lamp 10 according to the first embodiment, a heat spreader 16, a separation member 17, a support member 18, and wiring 19. In the lamp 20 according to the present embodiment, the space surrounded by the heat spreader 16, the casing 14, and the heat transfer unit 12 is a wire housing section. The LED module 11 is disposed to be distanced from the casing 14 by a separation member 17 one end of which is connected to the casing 14 and the other end of which is connected to the heat spreader 16. The LED module 11 is disposed at an opening of the reflector 13*a* on a light source side such that the LED-mounting surface faces an opening of the reflector 13*a* on a light emitting side. The heat transfer unit 12 includes two sets of a heat conductive section 12*a* and a heat dissipation section 12*b* which are integrally formed, the heat conductive section 12*a* is thermally connected to the heat spreader 16 at an end opposite to the heat dissipation section 12*b*, and the heat dissipation section 12*b* is thermally connected to the casing 14. Accordingly, the heat of the LED module 11 is dissipated into the casing 14 via the heat spreader 16, the heat conductive sections 12*a*, and the heat dissipation sections 12*b*. Moreover, the end of the reflector 13*a* on the LED module 11 side is supported by a support member 18 one end of which is connected to the casing 14 and the other end of which is connected to the reflector 13*a* instead of connecting to the LED module 11. The casing 14 includes a powder connector 14*a* which is a connection section adjacent to the wire housing section. The heat spreader 16 is disposed on and thermally connected to a side of the LED substrate of the LED module 11 opposite to the LED-mounting surface. The wiring 19 is connected from the connection section 14*a* of the casing 14 to the LED module 11 via the wire housing section. Except for these points, the lamp 20 according to the present embodiment has the same configuration as the lamp 10 according to the first embodiment, and the description of the lamp 10 can be incorporated in the description of the lamp 20 by reference.

Examples of a material for forming the separation member 17 include aluminium and resins. The separation member 17 may be a member capable of disposing the LED module 11 to be distanced from the casing 14 directly or indirectly. Examples of a material for forming the support member 18 include aluminium and resins. The support member 18 may be a member capable of disposing the reflector 13*a* on the light emitting side of the LED module 11.

With the heat spreader 16 included in the lamp 20 according to the present embodiment and the heat conductive section 12*a* and a heat dissipation section 12*b* included in each heat transfer unit 12, the heat of the LED module 11 can be really efficiently dissipated into the casing 14. Moreover, with the connection section 14*a* included in the casing 14, the lamp 20 can be easily replaced, and the aircraft landing guidance flash device can be easily maintained. Further, with the wire housing section, the wiring 19 in the lamp 20 can be converged into one place, for example. Thus, the space for the wiring can be reduced, and the size of the casing 14 can be reduced. Therefore, the weight increase can be further prevented. Accordingly, the lamp 20 according to the present embodiment can be used in an aircraft landing guidance flash device more favorably.

Although the present invention is described above with reference to embodiments, the present invention is not limited thereto. Various modifications on the configuration and details of the present invention that are understandable by a person skilled in the art are possible within a scope of the present invention.

Supplementary Notes

Some or all of the above-described embodiments and examples may be described, but are not limited to, as the following Supplementary Notes.

Supplementary Note 1

A lamp comprising:

an LED module serving as a light source;

a heat transfer unit;

a light distribution unit;

a casing comprising an opening; and a light transmissive cover, wherein the LED module comprises plural LEDs, and an LED substrate having an LED-mounting surface on which the plural LEDs are mounted, the light distribution unit is disposed on a light emitting side of the LED module, the LED module and the light distribution unit are disposed in the casing, the light transmissive cover is disposed over the opening of the casing, and the LED module is disposed in the casing to be distanced from the casing, and the heat transfer unit is disposed such that heat of the LED module can be dissipated into the casing.

Supplementary Note 2

The lamp according to Supplementary Note 1, wherein the heat transfer unit comprises a heat conductive section and a heat dissipation section, the heat conductive section is disposed such that heat of the LED module is conducted, and the heat dissipation section is disposed such that heat of the LED module can be dissipated into the casing.

Supplementary Note 3

The lamp according to Supplementary Note 2, wherein the heat dissipation section is formed at one end of the heat transfer unit, and the other end of the heat transfer unit is thermally connected to the LED module.

Supplementary Note 4

The lamp according to Supplementary Note 2 or 3, wherein the heat dissipation section is thermally connected to the casing.

Supplementary Note 5

The lamp according to any one of Supplementary Notes 1 to 4, wherein the heat transfer unit comprises a heat pipe.

Supplementary Note 6

The lamp according to any one of Supplementary Notes 1 to 5, further comprising:

a heat spreader, wherein the heat spreader is disposed on a side of the LED substrate opposite to the LED-mounting surface, and the heat transfer unit is thermally connected to the heat spreader.

Supplementary Note 7

The lamp according to any one of Supplementary Notes 1 to 6, wherein a space surrounded by the LED module, the casing, and the heat transfer unit in the casing is a wire housing section that houses wiring connected to the LED module.

Supplementary Note 8

The lamp according to Supplementary Note 7, wherein the casing comprises a connection section that can be connected to wiring outside the lamp, and the wiring housed in the wire housing section is connected to the connection section.

Supplementary Note 9

The lamp according to Supplementary Notes 1 to 8, wherein the casing comprises a through hole capable of introducing wiring from the outside of the casing to the inside of the casing.

Supplementary Note 10

The lamp according to any one of Supplementary Notes 1 to 9, wherein the light distribution unit comprises at least one of a reflector or a lens.

Supplementary Note 11

The lamp according to Supplementary Note 10, wherein the reflector has a tubular shape, the LED module is disposed at an opening of the reflector on a light source side such that the LED-mounting surface faces an opening of the reflector on a light emitting side.

Supplementary Note 12

The lamp according to any one of Supplementary Notes 1 to 11, for use in an aircraft landing guidance flash device.

The present invention can provide a lamp using an LED capable of preventing weight increase and dissipating heat of the LED module. The lamp of the present invention can be used for, for example, aircraft approach flash lighting systems and the like.

REFERENCE SIGNS LIST

10, 20 lamp
11 LED module
12 heat transfer unit;
12*a* heat conductive section
12*b* heat dissipation section
13*a* light distribution unit (reflector)
13*b* light distribution unit (lens)
14 casing
14*a* connection section (powder connector)
15 light transmissive cover
16 heat spreader
17 separation member
18 support member
19, 22 wiring
21 leg
23 arm
31 pole

The invention claimed is:

1. A lamp comprising:

an LED module serving as a light source;

a heat transfer unit;

a light distribution unit;

a casing comprising an opening;

a light transmissive cover;

a heat spreader;

an arm; and a leg, wherein the casing has a tubular member and a disc-shaped member, and is formed by disposing the disc-shaped member at an opening of the tubular member on the side opposite to the side on which the light transmissive cover is disposed, the LED module and the light distribution unit are disposed in the casing, the light distribution unit is disposed on a light emitting side of the LED module, the light transmissive cover is disposed over the opening of the casing, and is formed at the opening which is at a side of the casing opposite to a disc-shaped member of the casing, the LED module is disposed in the casing to be distanced from the casing, the heat spreader is disposed on an opposite side of the light emitting side of the LED module, the heat transfer unit is thermally connected to the heat spreader, and the heat transfer unit is disposed such that the heat of the LED module can be dissipated into the casing, and the heat transfer unit comprises a heat conductive section and a heat dissipation section, the heat conductive section is disposed such that heat of the LED module is conducted, the heat dissipation section is disposed such that heat of the LED module can be dissipated into the casing, and the heat dissipation section is formed at one end of the heat transfer unit, and the other end of the heat transfer unit is thermally connected to the LED module, and the heat dissipation section is thermally connected to the casing, the LED module is disposed at an opening of the reflector on a light source side such that the LED-mounting surface and the disc-shaped member each face in a same direction towards an opening of the reflector on a light emitting side, which is the side of the casing opposite to the disc-shaped member, the casing comprises a connection section impervious to water for reducing failures that can be connected to wiring outside the lamp, the wiring housed in the wire housing section is connected to the connection section, the leg is configured to support the lamp on a ground, the LED module is configured such that it can flash 120 times per 1 minute, and a brightness is switchable among three levels.

2. The lamp according to claim 1, wherein a space surrounded by the LED module, the casing, and the heat transfer unit in the casing is a wire housing section that houses wiring connected to the LED module, the casing comprises a connection section that can be connected to wiring outside the lamp, the wiring housed in the wire housing section is connected to the connection section, and the casing comprises a through hole capable of introducing wiring from the outside of the casing to the inside of the casing.

3. The lamp according to claim 1, wherein the leg has an arm that supports the casing, a pole that is connected to the leg, and the lamp is installed on the ground by the pole.

4. A lamp comprising:

an LED module serving as a light source;

a heat transfer unit;

a light distribution unit;

a casing comprising an opening;

a light transmissive cover;

a heat spreader;

an arm; and a leg, wherein the casing has a tubular member and a disc-shaped member, and is formed by disposing the disc-shaped member at an opening of the tubular member on the side opposite to the side on which the light transmissive cover is disposed, the LED module and the light distribution unit are disposed in the casing, the light distribution unit is disposed on a light emitting side of the LED module, the light transmissive cover is disposed over the opening of the casing, and is formed at the opening which is at a side of the casing opposite to a disc-shaped member of the casing, the LED module is disposed in the casing to be distanced from the casing, the heat spreader is disposed on an opposite side of the light emitting side of the LED module, the heat transfer unit is thermally connected to the heat spreader, and the heat transfer unit is disposed such that the heat of the LED module can be dissipated into the casing, and the heat transfer unit comprises a heat conductive section and a heat dissipation section, the heat conductive section is disposed such that heat of the LED module is conducted, the heat dissipation section is disposed such that heat of the LED module can be dissipated into the casing, and the heat dissipation section is formed at one end of the heat transfer unit, and the other end of the heat transfer unit is thermally connected to the LED module, and the heat dissipation section is thermally connected to the casing, the LED module is disposed at an opening of the reflector on a light source side such that the LED-mounting surface and the disc-shaped member each face in a same direction towards an opening of the reflector on a light emitting side, which is the side of the casing opposite to the disc-shaped member, the casing comprises a connection section impervious to water for reducing failures that can be connected to wiring outside the lamp, the wiring housed in the wire housing section is connected to the connection section, the leg is configured to support the lamp on a ground, and the lamp is for use in an aircraft landing guidance flash device.

5. The lamp according to claim 4, wherein a space surrounded by the LED module, the casing, and the heat transfer unit in the casing is a wire housing section that houses wiring connected to the LED module, the casing comprises a connection section that can be connected to wiring outside the lamp, the wiring housed in the wire housing section is connected to the connection section, and the casing comprises a through hole capable of introducing wiring from the outside of the casing to the inside of the casing.

6. The lamp according to claim 4, wherein the leg has an arm that supports the casing, a pole that is connected to the leg, and the lamp is installed on the ground by the pole.

* * * * *